United States Patent [19]

Morita et al.

[11] Patent Number: 5,001,104

[45] Date of Patent: Mar. 19, 1991

[54] HEAT-SENSITIVE RECORDING MATERIAL

[75] Inventors: Yasuyoshi Morita, Saitama; Masaaki Matsuoka, Tokyo; Satoshi Fukui, Tokyo; Kyoko Koyabu, Tokyo; Tatsuya Murata, Tokyo, all of Japan

[73] Assignee: Oji Paper Co., Ltd., Tokyo, Japan

[21] Appl. No.: 393,761

[22] Filed: Aug. 14, 1989

[30] Foreign Application Priority Data

Aug. 15, 1988 [JP] Japan ..... 63-203007
May 25, 1989 [JP] Japan ..... 1-132332

[51] Int. Cl.[5] ..... B41M 5/18

[52] U.S. Cl. ..... 503/209; 503/200; 503/208; 503/225; 503/226

[58] Field of Search ..... 427/150-152; 503/200, 208, 209, 226, 225

[56] References Cited

FOREIGN PATENT DOCUMENTS

| | | | |
|---|---|---|---|
| 32790 | 2/1986 | Japan | 503/226 |
| 95978 | 5/1986 | Japan | 503/226 |
| 110585 | 5/1986 | Japan | 503/209 |

*Primary Examiner*—Bruce H. Hess

*Attorney, Agent, or Firm*—Wenderoth, Lind & Ponack

[57] ABSTRACT

A heat-sensitive recording material in which a heat-sensitive recording layer containing a colorless to light-colored basic Leuco dyestuff and a color developer is tightly contacted with a thermal head to effect color development, characterized in that ammonium zirconyl carbonate is contained in said heat-sensitive color-developing layer or in an undercoating layer so as to offer a heat-sensitive recording material which is superior in its high speed printing properties and free from printing hindrances caused by smudge deposition or sticking.

6 Claims, No Drawings

HEAT-SENSITIVE RECORDING MATERIAL

FIELD OF THE INVENTION

This invention relates to a heat-sensitive recording material and more particularly to a heat-senitive recording material having superior continuous recording properties.

PRIOR ART

A heat-sensitive recording material taking advantage of the heating-color developing reaction between a usually colorless or light colored Leuco dyestuff and phenols or organic acids, is publicized for example in the U.S. Pat. No. 3,539,375, and is practiced extensively. In the actual application of the heat-sensitive recording material, there are employed a variety of heat transmission systems for forming the recording according to the type of application. In one of such systems, current pulses are supplied as a function of recording signals to a thermal head, that is an assembly of dot-like heat-producing electrical resistors, to produce Joule heat, which is then transmitted to a heat-sensitive chromogenic layer which is in intimate contact with the thermal head so producing a color recording image.

In the practical application of these systems, several well known disadvantages are present. One of the disadvantages is that the chromogenic materials that are in a heated and melted state (consisting mainly of color developers such as Leuco dyestuffs and phenols and so-called sensitizers such as heat-fusible organic compounds) are transferred and affixed to the thermal head.

This phenomenon, known as smudge deposition, occurs gradually in the course of continuous recording, until the intimate contact between the thermal head and the heat-sensitive recording layer is obstructed thus producing lower heat conductivity as well as causing deterioration in the recording image quality and the recording density.

Another known disadvantage is that the surfaces of the heat-sensitive recording layer and the thermal head become adhesive or sticky upon heat application. This phenomenon, known as "sticking", interferes with the smooth feed of the heat-sensitive recording material resulting in recording dropout or a distrubed image. In extreme cases, the heat-sensitive color-developing layer adheres to the thermal head making the continuous recording infeasible. To obtain smooth and continuous recording, it is necessary for the heat-sensitive recording material to be free of the above-mentioned problems of smudge deposition or sticking.

One method for suppressing the smudge deposition or sticking is to reduce the ratio of the fusible components in the heat-sensitive layer that may cause smudge deposition or sticking and to increase the compositional ratio of the pigments. However, this method is incompatible with the demand for higher sensitivity accompanying high speed printing. Although the smudge deposition and sticking may be suppressed, sufficient color developing concentration cannot be achieved at the low energy produced at the time of high speed printing.

Another known method is to include a high oil-absorbing pigment in the composition, as shown for example in the Japanese Patent Publication No. 56118/1986. However such methods do not satisfy the demand for higher sensitivity accompanying high speed operation due to, for example, the lowered printing density.

The above-mentioned phenomena of smudge deposition and sticking occurs on the interface between the heat-sensitive recording layer of the heat-sensitive recording material and the thermal head when contacted directly with the recording or color-developing layer. Although the provision of a protective layer on the heat-sensitive color-developing layer may be contemplated, the provision of such a protective layer inevitably results in impeded heat transmission from the thermal head to the heat-sensitive color-developing layer, and an insufficient color-developing concentration at the time of high speed printing.

Thus, there is a demand for a heat-sensitive recording material of the type in which the heat-sensitive color-developing layer is directly contacted with the thermal head and which is free from faults brought about by smudge deposition or sticking.

SUMMARY OF THE INVENTION

It is a principal object of the present invention to provide a heat-sensitive recording material of the type in which the heat-sensitive color-developing layer is contacted directly with the thermal head and which is superior in high speed printing properties and free from printing hindrances caused by smudge deposition or sticking.

DETAILED DESCRITION OF THE INVENTION

The present inventors have conducted research aimed at accomplishing the above object, and have found that, by including ammonium zirconyl carbonate in the composition of the heat-sensitive color-developing layer, it becomes possible to produce a heat-sensitive recording paper free of the problems of sticking or smudge deposition on the thermal head due to a heat-sensitive color-developing layer without lowering it's various recording properties. This finding has led to the completion of the present invention.

The present inventors have also found that similar effects may be achieved by providing an undercoating layer containing ammonium zirconyl carbonate between the substrate and the heat-sensitive color-developing layer.

In order to prevent the phenomena of smudge deposition or sticking without resorting to a protective layer, the present inventors have conducted research aimed at making use of an additive in the preparation of a heat-sensitive color-developing layer or an undercoating layer, in which the additive does not give rise to adverse effects such as a lowered sensitivity or cohesion of paints and which exhibits superior properties in preventing sticking or smudge deposition. As a result thereof, the present inventors have found that ammonium zirconyl carbonate $(NH_4)_2ZrO(CO_3)_2$, above all exhibits particularly outstanding effect. This finding has led to the completion of the present invention.

Zirconium compounds other than ammonium zirconyl carbonate, such as, for example, zirconium oxychloride $ZrOCl_2.8H_2O$, Zirconyl sulfate $ZrOSO_4.nH_2O$, zirconyl nitrate $ZrO(NO_3)_2.nH_2O$ or zirconyl acetate $ZrO(C_2H_3O_2)_2$, tend to cause lowered sensitivity, paint cohesion or thickening, while having a low capacity for preventing sticking or smudge deposition, so that they are not suited for achieving the object of the invention. Although the reason why ammonium zirconyl carbonate exhibits specific results has not yet become clear, it may be surmised that, besides the fact that the pH value is on the alkaline side so that the paint can be stably produced, and that gases such as ammonia or carbon dioxide are evolved at the time of coating and drying thus increasing the void ratio of the heat-sensitive layer and so improving the capacity for smudge absorption by the heat-sensitive recording layer, the reaction of ammonium zirconyl carbonate with the adhesive or fusible component is playing an important role.

It is also proposed in the Japanese Patent Public Disclosure (KOKAI) No. 110585/1986 that a protective layer be provided on a heat-sensitive color-developing layer containing a zirconium compound. However, since it is an object of the present invention not to provide a protective layer on the heat-sensitive color-developing layer, the proposal of the Japanese Patent Public Disclosure is not effective in accomplishing the object of the present invention. Thus, when the protective layer exists, thermal transmission from the thermal head to the heat-sensitive color-developing layer is obstructed by the intervening protective layer resulting in an inappropriate color developing concentration at the time of high speed printing. Moreover, the protective layer inhibits the effect of zirconium in preventing smudge deposition or sticking so that such a preventive effect is not exhibited. Thus the above proposal is not up to achieving the object of the present invention, and hence the heat-sensitive recording material exhibiting superior properties has been strongly desired.

According to the present invention, ammonium zirconyl carbonate is mixed into a coating solution designed for forming a heat-sensitive color-developing layer during preparation of the coating solution. In this coating solution, ammonium zirconyl carbonate is employed in an amount of 1 to 50 and preferably 3 to 20 parts by weight based on the amount of the basic dyestuff in the heat-sensitive color-developing layer. If the amount of ammonium zirconyl carbonate is less than 1 part by weight, the capacity for preventing sticking or smudge deposition becomes insufficient. On the other hand, if the amount exceeds 50 parts by weight, the coating solution is unsatisfactory with respect to the color developing concentration.

In the coating composition of the present invention for forming an undercoating layer containing ammonium zirconyl carbonate, 1 to 50 and preferably 3 to 20 parts by weight ammonium zirconyl carbonate are used in the undercoating layer with respect to the adhesive. If the contents are less than 1 part by weight, the capacity for preventing sticking and smudge deposition is insufficient. On the other hand, if the amount exceeds 50 parts by weight, the solution is unsatisfactory with respect to the color developing concentration.

In the undercoating layer, pigments, adhesives and occasionally surfactants, dispersants, thickners, waterproofing agents and defoaming agents may be contained, in addition to ammonium zirconyl carbonate.

A wide range of organic and inorganic pigments may be used as the pigments for the undercoating layer without any limitation on the capacity for oil absorption.

Examples of these pigments include calcined kaolin, kaolin, talc, barium sulfate, titanium oxide, calcium carbonate, synthetic silica, natural silica, polystyrene resin, polyethylene resin and urea formalin resin.

The mean particle size of the pigments is preferably 1 to 10 $\mu$m and more preferably 2 to 6 $\mu$m.

The adhesives may be water-soluble polymer materials, such as starch, starch derivatives, CMC, polyvinyl alcohol and hydrophobic emulsions such as SBR, MBR or acryl resins. Water-soluble resins and hydrophobic polymer materials analogous thereto may also be employed in the undercoating layer of the present invention.

The undercoating layer may usually be applied in an amount of 3 g/m$^2$ to 20 g/m$^2$.

For forming the undercoating layer, any coating devices or methods known in the art, such as air knives, blades, gravure, roll coaters, spraying, dipping, bars or extrusion, may be employed.

There is no specific limitation to the substrate material in the heat-sensitive recording material of the present invention. For example, paper, synthetic fiber paper or a synthetic resin film may be employed. Paper is usually preferable.

The heat-sensitive color-developing layer is formed on the undercoating layer.

There is also no limitation as to the colorless to light colored basic Leuco dyestuff employed for forming the heat-sensitive color-developing layer, or to the color developers. The basic dyestuffs may be enumerated by triaryl methane dyestuffs, such as 3,3-bis(p-dimethylaminophenyl)-6-dimethylaminophthalide, and fluorans such as 3-diethylamino-6-methyl-7-phenylaminofluoran, 3-dibutylamino-6-methyl-7-phenylaminofluoran, 3-(N-cyclohexyl-N-methylamino)-6-methyl-7-phenylaminofluoran, 3-dibutylamino-7-(o-chlorophenylamino)fluoran and 3-(N-ethyl-N-isoamyl)amino-6-methyl-7-phenylaminofluoran.

The acidic color developers may involve those having the properties of being liquified or fused by rise in temperature and of developing the color on contact with the basic dyestuffs, and may be enumerated by acidic organic substances, including phenolic compounds such as 4-tert-butyl phenol, 4-acetyl phenol, 4-tert-octyl phenol, 4,4'-sec-butylidene diphenol, 4-phenyl phenol, 4,4'-dihydroxydiphenyl methane, 4,4'-isopropylidene diphenol, hydroquinone, 4,4'-cyclohexylidene diphenol, 4,4'-dihydroxy diphenyl sulfide, 4,4'-thiobis(6-tert-butyl-3-methylphenol), 4,4'-dihydroxy diphenyl sulfone, 4-hydroxy-4'-isopropoxy diphenyl sulfone, 4-hydroxydibenzophenone, dimethyl 4-hydroxy phthalate, methyl 4-hydroxybenzoate, ethyl 4-hydroxybenzoate, propyl 4-hydroxybenzoate, 4-hydroxy benzoic acid-sec-butyl, phenyl 4-hydroxybenzoate, benzyl 4-hydroxybenzoate, tolyl 4-hydroxybenzoate, chlorophenyl 4-hydroxybenzoate or 4,4'-dihydroxy diphenyl ether, aromatic carboxylic acid, such as benzoic acid, p-tert-butylbenzoic acid, trichlorobenzoic acid, terephthalic acid, salicylic acid, 3-isopropyl salicylic acid, 3-tert-butyl salicylic acid, 3-benzyl salicylic acid, 3-($\alpha$-methylbenzyl) salicylic acid or 3,5-di-tert-butyl salicylic acid, and salts of these phenolic compounds or aromatic carboxylic acids with polyvalent metals, such as zinc, magnesium, aluminum or calcium.

For forming the heat-sensitive color-developing layer, commonly employed assistive substances may be used in combination. For example, p-benzylbiphenyl, dibenzyl terephthalate, 1-hydroxy-2-phenyl naphthoate, dibenzyl succinate, adipic acid di-o-chlorobenzyl, 1,2-di(3-methylphenoxy) ethane, succinic di-p-chlorobenzyl, may be employed as the sensitizer.

In preparing the coating solution for forming the heat-sensitive color-developing layer, the dyestuffs and the color developer are dispersed in water as the dispersion medium for producing a coating solution, using crushing devices, such as ball mills, attriters or sand grinders. In these coating solutions, 2 to 40 wt % and preferably 5 to 25 wt % of starches, hydroxy ethyl cellulose, methyl cellulose, carboxy methyl cellulose, gelatin, casein, gum arabic, polyvinyl alcohol, styrene maleic anhydride copolymer salts or styrene butadiene copolymer emulsions, based on the total solid contents, are employed. Various assistive agents may also be contained in the coating solution. For example, dispersants such as sodium dioctylsulfosuccinate, sodium dodecylbenzene sulfonate, lauryl alcohol sulfuric acid ester-sodium salts or metal salts of fatty acids, defoaming agents, fluororescent dyestuffs or coloring dyestuffs, may be employed. Inorganic pigments such as kaolin, clay, talc, calcium carbonate, calcined clay, titanium oxide, diatomaceous earth or finely divided anhydrous silica, may be employed for enhancing the whiteness of the heat-sensitive color-developing layer. Waxes such as liquid dispersions or emulsions of stearic acid, polyethylene, carnauba wax, paraffin wax, calcium stearate, zinc stearate or ester waxes may occasionally be contained in the coating solution.

In the heat-sensitive recording material of the present invention, there is no limitation to the method for forming the heat-sensitive color-developing layer. Any suitable coating devices, such as air knife coaters or blade coaters, may be employed in the method for coating the coating solution for forming the heat-sensitive color-developing layer on the substrate.

The heat-sensitive color-developing layer is formed in an amount of 2 to 12 g/m$^2$ and preferably 3 to 8 g/m$^2$ on the dry weight basis.

According to the present invention, a heat-sensitive recording material can be provide which is free from lowering in the recording sensitivity, smudge deposition or generation of sticking and which is superior in its high speed printing performance without provision of a protective layer.

EXAMPLES

The present invention will be explained more specifically with reference to Examples. In the following, parts are indicated as those by weight.

EXAMPLE 1

Liquid dispersion A having the following composition

| | |
|---|---|
| 3-(N-ethyl-N-isoamyl)-6-methyl-7-phenylamino fluoran | 20 parts |
| 10%-solution of polyvinyl alcohol | 10 parts |
| water | 70 parts |

was crushed by a sand grinder to a mean particle size of 2 μm.

Another liquid dispersion B has the following composition

| | |
|---|---|
| 4, 4'-isopropylidene diphenol | 10 parts |
| p-benzyl biphenyl | 10 parts |
| 10%-solution of polyvinyl alcohol | 10 parts |
| water | 70 parts. |

40 parts of the solution A, 160 parts of the solution B, 40 parts of calcium carbonate pigments, 20 parts of a 30%-liquid dispersion of paraffin, 180 parts of a 10%-aqueous solution of polyvinyl alcohol and 10 parts of a 13%-aqueous solution of ammonium zirconyl carbonate, manufactured by the Daiichi-Kigenso Kagaku Co., Ltd. under the trade name of "Zircosol AC-7", were mixed and agitated to produce a coating solution. This coating solution was coated onto a base paper of 50 g/m$^2$ to a dry weight of 7.5 g/m$^2$ to produce a heat-sensitive recording paper.

COMPARATIVE EXAMPLE 1

The operation was performed in the same way as in Example 1 with the exception of not using the aqueous solution of ammonium zirconyl carbonate in the preparation of the coating solution for preparing the color-developing layer.

COMPARATIVE EXAMPLE 2

The operation was performed in the same way as in Example 1 with the exception of using an aqueous solution of zirconium oxychloride in place of the aqueous solution of ammonium zirconyl carbonate in the preparation of the coating solution for preparing the color-developing layer.

COMPARATIVE EXAMPLE 3

The operation was performed in the same way as in Example 1 with the exception of using an aqueous solution of zirconyl nitrate in place of the aqueous solution of ammonium zirconyl carbonate in the preparation of the coating solution for preparing the color-developing layer.

COMPARATIVE EXAMPLE 4

The operation was performed in the same way as in Example 1 with the exception of using an aqueous solution of zirconyl acetate in place of the aqueous solution of ammonium zirconyl carbonate in the preparation of the coating solution for preparing the color-developing layer.

EXAMPLE 2

The following composition

| | |
|---|---|
| water | 100 parts |
| calcined clay ("Ansilex 93" manufactured by Engelhard Inc.) | 100 parts |
| 10%-polyvinyl alcohol ("GL 05" manufactured by Nihon Gosei Co., Ltd.) | 10 parts |
| 13%-ammonium zirconyl carbonate | 15 parts |

was dispersed for 5 minutes in a homogenizer and the resulting dispersion was mixed with 50 parts of 10%-polyvinyl alcohol ("GH 17" manufactured by Nihon Gosei Co., Ltd.) to produce a coating solution for the undercoating layer.

The coating solution was coated on a base paper of 50 g/m$^2$ in an amount of 7 g/m$^2$ and dried.

The coating solution for the color-developing layer employed in the Comparative Example 1 was coated on paper previously coated with the undercoating layer to a dry weight of 4.5 g/m$^2$ to produce the heat-sensitive recording paper.

COMPARATIVE EXAMPLE 5

A heat-sensitive recording paper was produced in the same way as in Example 2 with the exception of not using the aqueous solution of ammonium zirconyl carbonate in the preparation of the coating solution for the undercoating layer.

COMPARATIVE EXAMPLE 6

A heat-sensitive recording paper was produced in the same way as in Example 2 with the exception of using an aqueous solution of zirconium oxychloride in place of the aqueous solution of ammonium zirconyl carbonate in the preparation of the coating solution for the undercoating layer.

COMPARATIVE EXAMPLE 7

A heat-sensitive recording paper was produced in the same way as in Example 2 with the exception of using an aqueous solution of zirconium nitrate in place of the aqueous solution of ammonium zirconyl carbonate in the preparation of the coating solution for the undercoating layer.

COMPARATIVE EXAMPLE 8

A heat-sensitive recording paper was produced in the same way as in Example 2 with the exception of using an aqueous solution of zirconium acetate in place of the aqueous solution of ammonium zirconyl carbonate in the preparation of the coating solution for the undercoating layer.

Measurement of the recording sensitivity and evaluation of the smudge deposition and sticking were conducted on ten different sorts of heat-sensitive paper produced in the Examples and Comparative Examples. The results are shown in Table 1.

The recording sensitivity was measured using a commercially available heat-sensitive fascimile machine remodelled for the present testing. 64-line printing was performed under the condition of one-line recording time of 10 msec and scanning line density of 8×8 dots/mm while the pulse width was modulated and the impressed energy per dot was changed from 0.24 mj to 0.39 mj. The recording density at this time was measured by a Macbeth densitometer RD-914 as a value representative of the recording sensitivity of the heat-sensitive recording paper.

By way of testing smudge deposition on the thermal head, 100 m-printing was conducted using the above tester at the impressed energy per dot of 0.49 mj.

The mark O in the Table indicates an extremely small amount of smudge deposition on the head and hence no adverse effect on the image, whereas the mark Δ indicates a clearly noticeable smudge deposition and the mark X indicates an extremely large amount of smudge deposition. For checking the state of sticking, 800-line printing was conducted under the same conditions as above except using the one-line recording time of 100 msec instead of 10 msec. The mark O in the Table indicates no occurrence of sticking, whereas the mark Δ indicates noticeable sticking sound and the mark X indicates generation of a considerable sticking sound and disturbances not only in the image but also in the line-to-line interval.

TABLE 1

| | Recording Sensitivity | | Sticking | Smudge Deposition |
|---|---|---|---|---|
| | 0.27 mj/dot | 0.39 mj/dot | | |
| Example 1 | 1.02 | 1.35 | O | O |
| Comparative Example 1 | 1.01 | 1.36 | X | X |
| Comparative Example 2 | 0.95 | 1.28 | Δ | Δ |
| Comparative Example 3 | 0.92 | 1.25 | Δ | Δ |
| Comparative Example 4 | 0.93 | 1.25 | Δ | Δ |
| Example 2 | 1.15 | 1.38 | O | O |
| Comparative Example 5 | 0.91 | 1.25 | X | X |
| Comparative Example 6 | 0.80 | 1.17 | Δ | Δ |
| Comparative Example 7 | 0.83 | 1.20 | Δ | Δ |
| Comparative Example 8 | 0.85 | 1.20 | Δ | Δ |

What is claimed is:

1. A heat-sensitive recording material comprising a substrate sheet and a heat-sensitive recording layer on said substrate sheet containing a colorless to light-colored basic Leuco dyestuff and a color developer which is able to effect color development by direct contact of the recording layer with a thermal head, characterized in that ammonium zirconyl carbonate is contained in said heat-sensitive color-developing layer.

2. A heat-sensitive recording material according to claim 1 wherein said ammonium zirconyl carbonate is present in an amount sufficient to reduce smudge deposition and sticking between the heat-sensitive recording layer and the thermal head when said heat sensitive layer is contacted with said thermal head during a recording step.

3. A heat-sensitive recording material according to claim 2 on which the substrate is paper.

4. A heat-sensitive recording material comprising a substrate sheet, an undercoating layer formed on the substrate sheet and a heat-sensitive recording layer on said undercoating layer containing a colorless to light-colored basic Leuco dyestuff and a color developer which is able to effect color development by direct contact of the recording layer with a thermal head, characterized in that ammonium zirconyl carbonate is contained in said undercoating layer.

5. A heat-sensitive recording material according to claim 4 wherein said ammonium zirconyl carbonate is present in an amount sufficient to reduce smudge deposition and sticking between the heat-sensitive recording layer and the thermal head when said heat sensitive layer is contacted with said thermal head during a recording step.

6. A heat-sensitive recording material according to claim 5 on which the substrate is paper.

* * * * *